US008635732B2

(12) United States Patent
DeDominicis et al.

(10) Patent No.: US 8,635,732 B2
(45) Date of Patent: Jan. 28, 2014

(54) CLEANING ARTICLE COMPRISING MELAMINE FOAM SPONGE

(75) Inventors: Mattia DeDominicis, Gauteng (ZA); Kristina Wiltsee, Aukland (NZ)

(73) Assignee: Reckitt Benckiser LLC, Parsippany, NY (US)

( * ) Notice: Subject to any disclaimer, the term of this patent is extended or adjusted under 35 U.S.C. 154(b) by 1136 days.

(21) Appl. No.: 12/440,498

(22) PCT Filed: Aug. 10, 2007

(86) PCT No.: PCT/GB2007/003051

§ 371 (c)(1), (2), (4) Date: Oct. 19, 2009

(87) PCT Pub. No.: WO2008/032012

PCT Pub. Date: Mar. 20, 2008

(65) Prior Publication Data

US 2012/0324661 A1 Dec. 27, 2012

Related U.S. Application Data

(60) Provisional application No. 60/844,951, filed on Sep. 15, 2006.

(51) Int. Cl.
*A47L 13/17* (2006.01)

(52) U.S. Cl.
USPC ..... 15/104.94; 15/104.93; 15/244.1; 15/244.4; 510/295; 510/438; 510/439

(58) Field of Classification Search
USPC ..... 15/104.93, 104.94, 244.1–244.4; 401/161, 261–266; 510/295, 438, 439, 510/400, 407
See application file for complete search history.

(56) References Cited

U.S. PATENT DOCUMENTS

| | | | | |
|---|---|---|---|---|
| 4,666,948 | A | 5/1987 | Woerner et al. | |
| 4,854,761 | A * | 8/1989 | Smith et al. | 401/196 |
| 5,299,341 | A * | 4/1994 | Wakao | 15/210.1 |
| 5,468,418 | A * | 11/1995 | Rabone | 510/369 |
| 6,136,775 | A * | 10/2000 | Strout et al. | 510/439 |
| 6,825,158 | B2 * | 11/2004 | Mitra et al. | 510/295 |
| 6,936,578 | B2 * | 8/2005 | Cordellina et al. | 510/296 |
| 2005/0138742 | A1 * | 6/2005 | Jaszenovics et al. | 15/104.94 |
| 2005/0155631 | A1 | 7/2005 | Kilkenny et al. | |

FOREIGN PATENT DOCUMENTS

| | | | |
|---|---|---|---|
| EP | 1600096 | A | 11/2005 |
| EP | 1661503 | A | 5/2006 |
| JP | 11128137 | A | 5/1999 |
| WO | 94/23009 | * | 10/1994 |
| WO | 94/29427 | * | 12/1994 |
| WO | 96/18716 | * | 6/1996 |
| WO | 2005115215 | A | 12/2005 |

OTHER PUBLICATIONS

Partial machine translation of JP 11-128137, May 1999, 7 pages.*
English Language Abstract for JP11128137 taken from esp@cenet.com.

* cited by examiner

*Primary Examiner* — Mark Spisich
(74) *Attorney, Agent, or Firm* — Norris McLaughlin & Marcus PA

(57) ABSTRACT

A cleaning article comprising a melamine foam which comprises a cleaning fluid. Also disclosed a methods for the manufacture of said cleaning articles, and methods for their use in the treatment of hard surfaces.

7 Claims, 3 Drawing Sheets

CLEANING ARTICLE COMPRISING MELAMINE FOAM SPONGE

This is an application filed under 35 USC 371 of PCT/GB2007/003051, which claims benefit of U.S. Provisional Application No. 60/844,951, filed 15 Sep. 2006.

The present invention relates to cleaning articles, particularly sponges, which may be used in the treatment of surfaces, particularly hard surfaces.

Recently, melamine foams have come in to popular use as cleaning articles for the treatment of hard surfaces. Such foams are provided in a dry form and are advantageously used either in a dry state or may be hydrated, e.g., wetted by contacting the melamine foam with an aqueous composition or "neat" water. Such foams have been observed to be effective in the removal of stubborn stains, e.g., crayon marks or scuff marks from hard surfaces including painted wall surfaces and floors. When used in a dry state, the physical abrasion of the foam with the stained surface acts to abrade the stain and the surface until at least the stain is substantially removed. When hydrated prior to application on a hard surface, it is believed that the surface of the sponge is physically degraded and may break off in the form of small particles which are useful in abrasion of surface stains. This effect is advantageous in that the small particles act as "gentle abrasive" particles which improve the removal of said stains from the surface without unduly compromising or damaging the surface underlying the stain and/or in the locus of the stain. Such a stain removal operation is advantageous from a consumer standpoint.

Exemplary cleaning articles which include melamine foams are known from, e.g., US2006/0005338 A1, and melamine foams are known from, e.g., U.S. Pat. No. 6,350,511 B2. The directions for the use of said cleaning articles are they be used either in a dry state or alternately are intended to be wetted with water prior to use.

Notwithstanding the availability of such cleaning articles there remains a continuing need in the art for improved cleaning articles, particularly for cleaning articles useful in the treatment and removal of stains from hard surfaces.

The present invention relates to a cleaning article based on, or comprising a melamine foam which comprises a cleaning fluid which includes a hydrophobic liquid composition, as well as process for its manufacture and processes for its use.

In a first aspect of the present invention there is provided a cleaning article based on a melamine foam which comprises a cleaning fluid comprising a hydrophobic silicone emulsion composition.

In a second aspect of the invention there is provided a cleaning article based on a melamine foam comprising a cleaning fluid comprising a hydrophobic volatile silicon derivative.

In a third aspect of the invention there is provided a cleaning article based on a melamine foam which comprises a cleaning fluid comprising a hydrophobic volatile organic solvent composition.

In a fourth aspect of the invention there is provided a cleaning article based on a melamine foam which comprises a cleaning fluid comprising a paraffinic hydrocarbon solvent composition.

In a fifth aspect of the invention there is provided a cleaning article based on a melamine foam which comprises a cleaning fluid comprising an organic solvent composition, and particularly a glycol ether, lower alkyl monohydric alcohols and/or glycol.constituent.

In a sixth aspect of the invention there is provided a cleaning article based on a melamine foam which comprises a cleaning fluid comprising an essential oil or other naturally derived oil constituent, e.g. terpene hydrocarbons.

In a seventh aspect of the invention there is provided a cleaning article based on a melamine foam which comprises a cleaning fluid which comprises one or more surfactants.

In a eighth aspect of the invention there is provided a cleaning article based on a melamine foam according to one or more of the prior aspects of the invention which additionally comprises water.

In a ninth aspect of the invention there is provided a method for the manufacture of a cleaning article comprising a melamine foam according to one or more of the prior aspects of the invention.

In a tenth aspect of the invention there is provided a cleaning article which comprises a melamine foam, and a water soluble sachet or package which contains a cleaning fluid and optionally, water.

In a eleventh aspect of the invention there is provided a kit which includes one or more cleaning article(s) based on a melamine foam, and at least one container which comprises a cleaning fluid and optionally water.

In an twelfth aspect of the invention there is provided a method of treating a hard surface which comprises the step of:

contacting a hard surface in need of treatment with a cleaning article according to any of the first through seventh aspects of the invention, or with a cleaning article formed from a kit according to the eleventh aspect of the invention.

In a thirteenth aspect of the invention there is provided a method for the manufacture of a cleaning article according to any of the prior first through seventh aspects of the invention.

These and other aspects of the invention will be better understood from a reading of the following specification.

FIG. 1. depicts a first embodiment of a cleaning implement of the invention.

Figure 4:
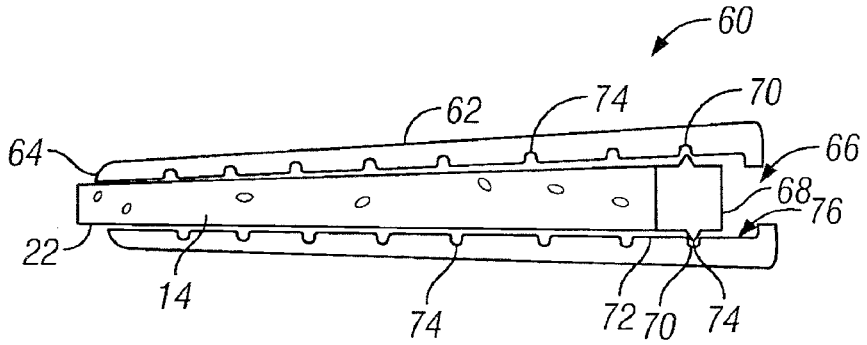

FIG. 4 a depicts a cross-sectional view of a further embodiment of a cleaning implement.

Figure 5:
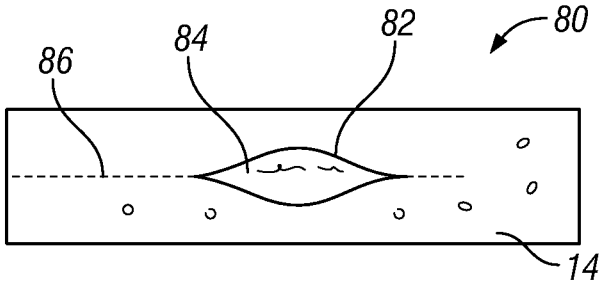

FIG. 5 depicts an embodiment of a cleaning implement, which comprises a sachet in the interior of a melamine foam body.

Figure 6:
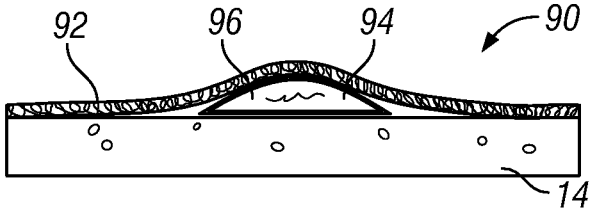

FIG. 6 depicts a further embodiment of a cleaning implement which comprises a multilayered construction which includes a melamine foam having one surface layered with a non-woven abrasive layer and a sachet in between the melamine foam and the abrasive layer.

As noted, broadly speaking, the subject matter of the present invention relates to a cleaning article based on, or comprising a melamine foam, which cleaning article comprises a cleaning fluid. The cleaning fluid may alternately which may be supplied to the melamine foam of the cleaning article. The present application also relates to processes for the manufacture of such cleaning articles, as well as processes for their use. The present invention also relates to kits which include a cleaning article based on, or comprising a melamine foam, and a vessel or container containing a quantity of a cleaning fluid.

An essential element of the present invention is a cleaning article comprising a melamine foam. Such melamine foams are per se, known to the art. For example, such a melamine foam may be produced by foaming an aqueous solution of a melamine foam condensation product which comprises an emulsifier, a curing agent and a blowing agent, e.g., a $C_4$-$C_8$ hydrocarbon and curing the melamine foam condensate at an elevated temperature. More specifically the melamine foam may be formed from melamine-formaldehyde precondensates. Melamine-formaldehyde precondensates may, in addition to melamine, contain up to 50% by weight, preferably up to 20% by weight, of other thermoset resin precursors as co-condensed units, and may, in addition to formaldehyde, contain up to 50% by weight, preferably up to 20% by weight, of other aldehydes as co-condensed units, though an unmodified melamine-formaldehyde condensate is particularly preferred. Examples of additional thermoset resin precursors which may be present are alkyl-substituted melamine, urea, urethanes, carboxylic acid amides, dicyandiamide, guanidine, sulfurylamide, sulfonic acid amides, aliphatic amines, phenol and its derivatives. Examples of other aldehydes which may be employed are acetaldehyde, trimethylolacetaldehyde, acrolein, benzaldehyde, furfuraldehyde, glyoxal, phthalaldehyde and terephthalaldehyde. The thermoset resin precursor:aldehyde molar ratio may vary within wide limits, namely from 1:1.5 to 1:5; in the case of melamine-formaldehyde condensates, it is preferably from 1:2.5 to 1:3.5. The melamine resins advantageously contain co-condensed sulfite groups; there may be introduced, for example, by adding from 1 to 20% by weight of sodium bisulfite during or after the condensation of the resin. The sulfite groups make the resin more hydrophilic and hence more compatible with water. Furthermore, higher degrees of condensation are achieved.

The fineness of the foam cells can be influenced, and varied in a controlled manner, by using a suitable emulsifier, preferably in an amount of from 0.2 to 5% by weight, based on resin. This emulsifier reduces the surface tension and thereby facilitates the continuous formation of fresh surface, which is an integral part of the foaming process. If organic hydrophobic blowing agents are used, the emulsifier reduces the interfacial tension between these and the hydrophilic resin/water phase and thereby permits homogeneous emulsification of the two phases. Accordingly it stabilizes the system and prevents phase separation of the latter during foaming, which would result in an inhomogeneous foam. The higher the foaming temperature, the more effective the emulsifier needs to be, and the higher must be the concentration in which it is used.

Suitable emulsifiers include, e.g., anionic compounds as well as metal salts of anionic compounds. Preferred emulsifiers based on anionic compounds and/or salts include alkylsulfonates and alkylarylsulfonates, where alkyl is of 8 to 20 carbon atoms which compounds may be provided as an salt thereof, e.g., a sodium or potassium salt, and preferably metal salts thereof. Further exemplary useful emulsifiers based on anionic compounds include sulfosuccinic acid esters, sulfonated castor oils, alkylnaphthalenesulfonic acids, phenolsulfonic acids and sulfuric acid esters, for example of $C_{12}$-$C_{18}$-alkyl hydrogen sulfates and $C_{16}$-$C_{18}$-fatty alcohol hydrogen sulfates, as well as salts thereof, preferably metal salts. Further suitable emulsifiers include cationic compounds. Preferred emulsifiers based on cationic compounds include oleic acid esters of triethanolamine, or laurylpyridinium chloride, as well as salts thereof. Yet further suitable emulsifiers include non-ionic compounds. Exemplary useful emulsifiers based on non-ionic compounds include oxyethylated castor oil, oxyethylated tallow alcohols, oxyethylated stearic acid or oleic acid, and oxyethylated nonylphenol. Such emulsifiers may be used singly or in mixtures of two or more emulsifiers, and may be used in any effective amount.

In order to produce a foam from a pourable mixture, the latter must contain a blowing agent, the amount depending on the desired foam density. In principle, either physical or chemical blowing agents may be used in the process according to the invention. Examples of physical blowing agents are hydrocarbons, halohydrocarbons, especially fluorohydrocarbons, alcohols, ethers, ketones and esters in liquid form, or air and $CO_2$ in gaseous form. Examples of suitable chemical blowing agents are isocyanates used as a mixture with water, which liberates $CO_2$ as the effective blowing agent, as well as carbonates and bicarbonates used as a mixture with acids, which again generates $CO_2$, and azo compounds, such as azodicarboxamide. However the primary blowing is typically the water or the alcohol present as solvents in the system. Frequently however an auxiliary blowing agent of the type described above is advantageously admixed to the aqueous solution or dispersion. Exemplary auxiliary blowing agents include $C_4$-$C_{12}$ alkyl compounds, e.g., pentane, hexane, and/or fluorocarbons, e.g., trichlorofluoromethane and trichlorotrifluoroethane. It is advantageous if the boiling point of the auxiliary blowing agent is substantially below that of the solvent because the sequence in which the auxiliary blowing agent and the primary blowing agent are volatilized is of considerable importance. Since the foam volume produced is usually very largely attributable to the volatilized water and only a minor proportion is usually due to the auxiliary blowing agent, it is hypothesized that the latter serves as a nucleating agent. The total amount of blowing agent depends on the desired final density of the foam; for densities of 1.6 $g.l^{-1}$ and 30 $g.l.^{-1}$ it is, respectively, about 28 moles and about 1.5 moles per kg of resin. The molar amounts in each case relate to the effective total blowing gas. In the preferred embodiment described above, from 1 to 40% by weight, based on the resin, of a physical auxiliary blowing agent having a boiling point of from 0° C. to 80° C. is added to the aqueous solution or dispersion; in the case of pentane, it is preferably from 5 to 15% by weight, in the case of trichlorofluoromethane from 15 to 25% by weight and in the case of trifluorotrichloroethane from 25 to 35% by weight. Of course it is contemplated that other auxiliary blowing agents not specifically recited herein but known to the art may also be utilized.

The hardeners employed are compounds which, under the reaction conditions, split off or form protons, which then catalyze the further condensation of the melamine resin. The amount of hardener is from 0.01 to 20, preferably from 0.05 to 5, % by weight based on resin. Suitable hardeners include inorganic acids as well as organic acids, for example hydrochloric acid, sulfuric acid, phosphoric acid, formic acid, acetic acid, oxalic acid, lactic acid and amino acids, as well as latent hardeners, such as halocarboxylic acid salts, chloroacetamide, hydrogen phosphates, acid anhydrides and ammonium salts. Formaldehyde itself can, at high temperatures, act as a hardener because it undergoes disproportionation, with formation of formic acid.

The aqueous or alcoholic solution or dispersion is preferably free from other additives. However, for some purposes it can be advantageous to add up to 20% by weight, though preferably less than 10% by weight, based on resin, of conventional additives, such as fibrous or pulverulent inorganic reinforcing agents or fillers, pigments, colorants, flameproofing agents, plasticizers or agents to reduce the toxicity of the combustion gases or to promote carbonization, as well as stabilizers, auxiliary blowing agents, fragrances, deodorizers, colorants, one or more detersive surfactants, abrasive powders and the like. Preferably, all such fillers, stabilizers, additives and the like will be substantially nonreactive under the conditions of foam formulation.

Since the foams in general have an open cell structure and can absorb water, it may, for certain applications, be necessary to add from 0.2 to 5% by weight of hydrophobic agents.

These may be, for example, alkylphenols, where alkyl is of 5 to 15 carbon atoms, silicones and paraffins.

When included in the compositions, the additives are mixed homogeneously with the aqueous solution or dispersion of the melamine resin and at the same time the auxiliary blowing agent can be forced in, if appropriate under pressure. However, it is also possible to start from a solid, for example a spray-dried, melamine resin and mix this with an aqueous solution of the emulsifier and the hardener, and with the auxiliary blowing agent, if any.

The concentration of melamine-formaldehyde precondensate in the mixture of precondensate and solvent can vary within wide limits, namely from 20 to 95, preferably from 50 to 85, % by weight. The preferred viscosity of the mixture of precondensate and solvent is from 1 to 3,000 dPa·s, preferably from 5 to 2,000 dPa·s.

When physical auxiliary blowing agents are used, the mixture is brought to the boiling point of the blowing agent in the solution or dispersion at the particular pressure; in the case of chemical blowing agents, the solution or dispersion must be heated to a temperature at which the blowing gas is liberated at an adequate rate.

Although the melamine-formaldehyde precondensate may be heated in order to form and cure the resultant melamine foam, it is contemplated that other techniques may be practiced as well. In one alternative the heating of the solution or dispersion is affected by ultra-high frequency irradiation. Such irradiation can in principle employ microwaves in the frequency range of from 0.2 GHz to 100 GHz. For industrial operation, frequencies of 0.915, 2.45 and 5.8 GHz are available, amongst which 2.45 GHz is particularly preferred. The source of the radiation may be provided by any suitable means, e.g. a magnetron, and irradiation can also be carried out with several magnetrons simultaneously. Such a technique is described in U.S. Pat. No. 4,334,971 the contents of which are herein incorporated by reference.

The melamine foam may also be produced to further comprise an ammonium salt, as described in U.S. Pat. No. 6,350,511 the contents of which are herein incorporated by reference. Other melamine foams and methods for their production which are useful in the context of the present invention include those described in U.S. Pat. No. 4,511,678, as well as U.S. Pat. No. 4,540,717, the contents of which are also incorporated by reference herein. Additionally, or as an alternative thereto, the melamine foam can be produced by the method described in US 2006/0005338 A1 particularly as described at paragraph 0043-0051. Therein is described a method for producing a melamine foam from various precursors and starting materials, as well as various agivants which can also be used in the foam forming composition. The process described therein utilizes an electromagnetic wave for eradiating and accelerating the curing reaction of the reaction mixtures in order to form the final melamine foam article.

Most preferably the melamine foam used for the cleaning article is a foam product commercially available as BASOTECT (ex. BASF AG) which is described to be a foam based on melamine-formaldehyde resins. These foam products exhibit a high elasticity as a result of its open cells and a low density, both advantageous properties with respect to both handling and processing of the foam products.

A further essential element of the invention is a cleaning fluid which includes a non-aqueous constituent. In certain aspects of the invention the cleaning fluid may be a hydrophobic liquid constituents and it is generally contemplated that any hydrophobic liquid constituent may be used, and such constituent may take the form of "neat" liquids which are essentially a single fluid and wherein the cleaning fluid consists essentially of the single hydrophobic liquid constituent, as well as mixtures of two or more liquids at least one of which must be a hydrophobic liquid, as well as emulsions and microemulsions such as water-in-oil and oil-in-water emulsions which include at least one hydrophobic liquid constituent. The term "hydrophobic liquid" as used herein is intended to encompass liquids which are sparingly soluble in water, e.g., not more than about 5% soluble in water, preferably not more than 4%, still more preferably not more than 3%, yet more preferably not more than 2% soluble in water, but more preferably are not more than 1%, still more preferably are not more than 0.5% soluble in water on an weight basis. Advantageously the hydrophobic components are not more than about 0.25% wt. soluble in water, and in certain particularly preferred embodiments are considered insoluble in water.

In certain preferred aspects the cleaning fluid comprises at least 50% wt, more preferably at least 70% wt. yet more preferably at least about 80% wt, and still more preferably at least 90% wt. of a hydrophobic liquid constituent. Advantageously the cleaning fluid comprises a single hydrophobic liquid, or a mixture of liquids which comprise one or more hydrophobic liquid constituent(s) wherein at least 95%, more preferably at least 98% and yet more preferably at least 99.5% wt, is one or more a hydrophobic liquids. Most preferably however the cleaning fluid consists essentially of one or more hydrophobic liquids.

In addition to the above recited hydrophobic characteristics, preferred hydrophobic liquids are also volatile. With respect to volatility, such may be determined by conventional quantitative methods, especially by measuring the vapor pressure of the hydrophobic liquid at atmospheric pressure at 20° C. Preferred hydrophobic liquids are those which exhibit a vapor pressure of at least 0.20 millibar ("mbar"), preferably at least 0.4 mbar, and most preferably a vapor pressure of at least 1 mbar.

Virtually any material which exhibits the required degree of hydrophobicity and preferably which also exhibit the required degree of volatility may be used as, or as a constituent of, the cleaning fluid. Without limitation such include hydrophobic organic solvents, as well as volatile silicone derivatives, silicone emulsions, and the like. In certain preferred embodiments volatile silicone derivatives, silicone emulsions, and the like form an essential part of the hydrophobic organic solvent constituent, and in certain further preferred embodiments include such volatile silicone derivatives, silicone emulsions, and the like to the exclusion of other hydrophobic organic solvents. In certain alternate preferred embodiments the hydrophobic organic solvent constituent includes one or more organic solvents, and in certain further preferred embodiments includes said one or more organic solvents to the exclusion of volatile silicone derivatives, silicone emulsions, and the like. Additionally the cleaning fluid may further optionally comprise water, although in certain particularly preferred embodiments the cleaning fluid excludes added water, namely water which is added in excess of any water which may form part of a commercial preparation of hydrophobic organic solvents, as well as volatile silicone derivatives, silicone emulsions. The term "added water" in intended to encompass any aqueous phase, or portion of a cleaning fluid constituent, e.g., e.g., a silicone emulsion which includes water; the term "added water" would not include the aqueous portion of such a silicone emulsion. However, in certain specific preferred embodiments the cleaning fluid comprises, in order of increasing preference, less than 5%, 4.5%, 4%, 3.5%, 3%, 2.5%, 2%, 1.5%, 1%, 0.75%, 0.5%, 0.25%, 0.1%, 0.05% of water in percentage weight of water and in certain especially preferred embodiments the cleaning fluid is anhydrous.

The cleaning fluid may comprise volatile silicone derivatives, hydrophobic silicone emulsions, silane compounds and the like. Silicon derivatives which find use in the invention include, e.g., cyclic or linear polydialkylsiloxane, linear siloxy, silane compounds as well as silanes.

Exemplary useful cyclic polydialkylsiloxanes may be generally represented by the following formula:

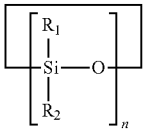

wherein:

$R_1$ and $R_2$ are independently selected from $C_1$ to $C_{12}$ alkyl, aryl or alkylaryl, but preferably are selected from $C_1$ to $C_8$ alkyl, aryl or alkylaryl; and, n has a value from 2 to 16, preferably has a value between 3 and 8, more preferably has a value of between 3 and 6. These compounds are frequently also described as polydimethylcyclosiloxanes.

Exemplary useful linear polydialkylsiloxanes have from about 2 to 18, preferably between about 2 and 10 silicon atoms and may be represented by the following general formula:

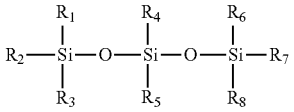

wherein $R_1$, $R_2$, $R_3$, $R_4$, $R_5$, $R_6$, $R_7$ and $R_8$ can independently be saturated or unsaturated $C_1$-$C_8$ alkyl, aryl, alkylaryl, hydroxyalkyl, amino alkyl or alkyl siloxy.

Exemplary useful linear siloxy compounds may be represented by the following general formula:

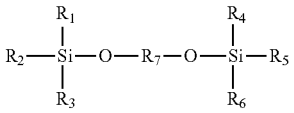

wherein $R_1$, $R_2$, $R_3$, $R_4$, $R_5$, and $R_6$ are independently selected from saturated or unsaturated $C_1$-$C_8$ alkyl, aryl and alkyl aryl and $R_7$ is $C_1$-$C_8$ alkylene, preferably $C_1$-$C_4$ alkylene.

Exemplary useful silane compounds have the general formula:

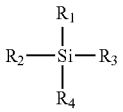

wherein $R_1$, $R_2$, $R_3$, and $R_4$ are independently be selected from $C_1$-$C_8$ alkyl, aryl, alkylaryl, hydroxyalkyl and alkylsiloxy.

In the foregoing the volatile silicon derivatives, substitution of some of the methyl groups with other organic or organo functional groups, such as vinyl, phenyl, trifluoropropyl, and amino, other organopolysiloxane fluids is contemplated and considered to fall within the scope of the present invention.

It is to be understood that the aforesaid volatile silicone derivatives and/or emulsions thereof may be used individually, or in mixtures of two or more thereof.

Examples of certain silicones of the above types, both cyclic and linear, available in commercial preparations are offered by Dow Corning 344, 345 and 200 fluids (ex. Dow Corning Corp.), as well as Silicone 7202 and Silicone 7158 fluids (ex. Union Carbide Corp.). The linear volatile silicones generally have viscosities of less than about 5 centistokes at 25° C. while the cyclic materials generally have viscosities less than about 10 centistokes.

The volatile silicon derivatives may be supplied as "neat" fluids which are essentially anhydrous in nature and consist essentially of, or primarily of, the volatile silicone derivative which is fluid or is a flowable mass at room temperature, or the volatile silicon derivatives may be supplied as aqueous based emulsions containing one or more of the foregoing volatile silicon derivatives and optionally contain one or more surfactants. When the volatile silicon derivatives are provided as aqueous based emulsions, the amount of water which can be present in said emulsion is preferably from about 65% to about 660% by weight, based on the weight of the silicone fluid. However, the amount of water can be as high as about 5000% by weight if desired.

A particularly preferred constituent for use in the present invention is a volatile polydimethylcyclosiloxane which is primarily cyclopentasiloxane according to the following general formula:

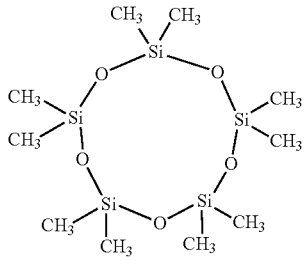

This polydimethylcyclosiloxane presently commercially available material sold as Dow Corning 245.

The cleaning fluid of the invention may include a volatile organic solvent, which may be one or more organic solvents, including, inter alia, glycol ethers, lower alkyl monohydric alcohols, and glycols. While any organic solvent may be used, the preferred organic solvents include glycol ethers, lower alkyl monohydric alcohols, glycols. These organic solvents may be used singly, or in mixtures of two or more.

Exemplary useful glycol ethers are those having the general structure $R_a$—O—$R_b$—OH, wherein $R_a$ is an alkyl of 1 to 20 carbon atoms, or an aryl of at least 6 carbon atoms, and $R_b$ is an alkylene of 1 to 8 carbons or is an ether or polyether containing from 2 to 20 carbon atoms. Specific exemplary glycol ethers include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, dipropylene glycol monobutyl ether and mixtures thereof. Preferred are glycol ethers having one to five glycol monomer units. Examples of more preferred glycol ethers include those denoted in the examples below. Such materials are commercially available in the DOWANOL series (from The Dow Chemical Company, Midland Mich.), as well as in the ARCOSOLV P series (from Arco Chemical Co., Newton Square Pa.). Exemplary useful glycols include glycols containing from 1 to 18 carbon atoms, and preferably are glycols containing from 1 to 8 carbon atoms.

Exemplary useful alcohols include linear and branched primary and secondary alcohols having from 1 to 12 carbon atoms, but preferably are those which contain from 1 to 8 carbon atoms. Preferred alcohols include ethanol, propanol, butanol, pentanol and hexanol in any isomeric form, such as n-propanol, isopropanol, n-, sec- and tert-butanol.

The cleaning fluid of the invention may include a paraffinic hydrocarbon solvent composition. These isoparaffinic hydrocarbon solvent solvents may be used singly, or in mixtures of two or more. Exemplary paraffinic hydrocarbons including both linear and branched paraffinic hydrocarbons. The former are commercially available as NORPAR solvents (ex. ExxonMobil Corp.) while the latter are available as ISOPAR solvents (ex. ExxonMobil Corp.) Mixtures of branched hydrocarbons especially as isoparaffins form a further particularly preferred form of a useful hydrocarbon solvent of the invention. Particularly useful technical grade mixtures of isoparaffins include mixtures of isoparaffinic organic solvents having a relatively narrow boiling range. Examples of these commercially available isoparaffinic organic solvents include ISOPAR C described to be primarily a mixture of $C_7$-$C_8$ isoparaffins, ISOPAR E described to be primarily a mixture of $C_8$-$C_9$ isoparaffins, ISOPAR G described to be primarily a mixture of $C_{10}$-$C_{11}$ isoparaffins, ISOPAR H described to be primarily a mixture of $C_{11}$-$C_{12}$ isoparaffins, ISOPAR J, ISOPAR K described to be primarily a mixture of $C_{11}$-$C_{12}$ isoparaffins, ISOPAR L described to be primarily a mixture of $C_{11}$-$C_{13}$ isoparaffins, ISOPAR M described to be primarily a mixture of $C_{13}$-$C_{14}$ isoparaffins, ISOPAR P and ISOPAR V described to be primarily a mixture of $C_{12}$-$C_{20}$ isoparaffins.

The cleaning fluid of the invention may include an essential oil or other naturally derived oil constituent, e.g. terpene hydrocarbons. Essential oils are highly scented droplets found in minute quantities in the flowers, stems, leaves, roots and barks of aromatic plants. They are highly fluid and exceptionally volatile and potent. Because of their high potency, very small amounts of essential oil are needed to experience their benefits.

Essential oils are complex mixtures of different organic molecules, such as terpenes, alcohols, esters, aldehydes, ketones and phenols. It is believed that it is the interaction between each and every component and/or molecule that gives an essential oil its particular character and unique therapeutic properties. Therefore, the use of one or more essential oils in the present inventive composition is contemplated.

A variety of essential oils may be used for the present invention. Suitable essential oils for use in the present lotion composition include, for example, *Abies Sibirica* Oil, *Amyris Balsamifera* Oil, Anise (*Illicium Verum*) Oil, Balm Mint (*Melissa Officinalis*) Oil, Basil (*Ocimum Basilicum*) Oil, Bay (*Pimenta Acris*) Oil, Bee Balm (*Monarda Didyma*) Oil, Bergamot (*Citrus Aurantium Bergamia*) Oil, Birch (*Betula Aba*) Oil, Bitter Orange (*Citrus Aurantium Amara*) Oil, Cabbage Rose (*Rosa Centifolia*) Oil, *Calendula Officinalis* Oil, California Nutmeg (*Torreya Californica*) Oil, *Camellia Sinensis* Oil, *Capsicum Frutescers* Oleoresin, Caraway (*Carum Carvi*) Oil, *Cardamon* (*Elettaria Cardamomum*) Oil, Cedarwood (*Cedrus Atlantica*) Oil, *Chamaecyparis Obtusa* Oil, Chamomile (*Anthemis Nobilis*) Oil, Cinnamon (*Cinnamomum Cassia*) Oil, Citronella (*Cymbopogon Nardus*) Oil, Clary (*Salvia Sclarea*) Oil, Clove (*Eugenia Caryophyllus*) Oil, Cloveleaf (*Eugenia Caryophyllus*) Oil, Coriander (*Coriandrum Sativum*) Oil, Coriander (*Coriandrum Sativum*) Seed Oil, *Cyperus Esculentus* Oil, Cypress (*Cupressus Sempervirens*) Oil, *Eucalyptus Citriodora* Oil, *Eucalyptus Globulus* Oil, Fennel (*Foeniculum Vulgare*) Oil, *Gardenia Florida* Oil, *Geranium Maculatum* Oil, Ginger (*Zingiber Officinale*) Oil, Gold of Pleasure (*Camelina Sativa*) Oil, Grapefruit (*Citrus Grandis*) Oil, Hops (*Humulus Lupulus*) Oil, *Hypericum* Perforatum Oil, *Hyptis Suaveolens* Oil, Indigo Bush (*Dalea Spinosa*) Oil, Jasmine (*Jasminum Officinale*) Oil, *Juniperus Communis* Oil, *Juniperus Virginiana* Oil, Labdanum (*Cistus Labdaniferus*) Oil, Laurel (*Laurus Nobilis*) Oil, Lavandin (*Lavandula Hybrida*) Oil, Lavender (*Lavandula Angustifolia*) Oil, Lemon (*Citrus Medica Limonum*) Oil, Lemongrass (*Cymbopogon Schoenanthus*) Oil, *Leptospermum Scoparium* Oil, Lime (*Citrus Aurantifolia*) Oil, Linden (*Tilia Cordata*) Oil, *Litsea Cubeba* Oil, Lovage (*Levisticum Officinale*) Oil, Mandarin Orange (*Citrus Nobilis*) Oil, Massoy Bark Oil, Matricaria (*Chamomilla Recutita*) Oil, Moroccan Chamomile Oil, Musk Rose (*Rosa Moschata*) Oil, Myrrh (*Commiphora Myrrha*) Oil, Myrtle (*Myrtus Communis*) Oil, Norway Spruce (*Picea Excelsa*) Oil, Nutmeg (*Myristica Fragrans*) Oil, *Olax Dissitiflora* Oil, *Olibanum, Opoponax* Oil, Orange (*Citrus Aurantium Dulcis*) Flower Oil, Orange (*Citrus Aurantium Dulcis*) Oil, Palmarosa (*Cymbopogon Martini*) Oil, Parsley (*Carum Petroselinum*) Seed Oil, Passionflower (*Passiflora Incarnata*) Oil, Patchouli (*Pogcstemon Cablin*) Oil, *Pelargonium Graveolens* Oil, Pennyroyal (*Mentha Pulegium*) Oil, Peppermint (*Mentha Piperita*) Oil, Pine (*Pinus Palustris*) Oil, Pine (*Pinus Palustris*) Tar Oil, Pine (*Pinus Pinea*) Kernel Oil, Pine (*Pinus Pumiho*) Oil, Pine (*Pinus Sylvestris*) Cone Oil, Rosemary (*Rosmarinus Officinalis*) Oil, Rose Oil, Rosewood (*Aniba Rosseodora*) Oil, Rue (*Ruts Graveolens*) Oil, Sage (*Salvia Officinalis*) Oil, *Sambucus Nigra* Oil, Sandalwood (*Santalum Album*) Oil, Sandarac (*Callitris Quadrivalvis*) Gum, *Sassafras Officinale* Oil, *Sisymbrium Ino* Oil, Spearmint (*Mentha Viridis*) Oil, Sweet Marjoram (*Origanum Majorana*) Oil, Sweet Violet (*Viola Odorata*) Oil, Tar Oil, *Thuja* Occidentalis Oil, Thyme (*Thymus Vulgaris*) Oil, *Vetiveria Zizanoides* Oil, Wild Mint (*Mentha Arvensis*) Oil, Ximenia Americana Oil, Yarrow (*Achillea Millefolium*) Oil, Ylang Yang (*Cananga Odorata*) Oil, or any combinations thereof.

The cleaning fluid of the invention may also include one or more surfactants, which may be any suitable anionic, cationic, amphoteric or nonionic detersive material. Exemplary useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$-$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain. Exemplary useful are linear straight chain alkylbenzene sulfonates in which the average number of carbon atoms in the alkyl group is from about 11 to 14.

Other anionic surfactants herein are the water soluble salts of: paraffin sulfonates containing from about 8 to about 24

(preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Also useful as the anionic surfactant constituent are carboxylates such as alkyl carboxylates which include those which may be represented by the general formula:

$$R—COO^-M^+$$

wherein R is a straight or branched hydrocarbon chain containing from about 9 to 21 carbon atoms, and M is a metal or ammonium ion; polyalkoxycarboxylates, representative of which are polyethoxycarboxylates which may be represented by the general formula:

$$R—[—OCH_2CH_2—]_n—CH_2COO^-M^+$$

wherein R is a straight chained or branched hydrocarbon chain which may include an aryl moiety, but is desirably a straight chained or branched hydrocarbon chain; and n is an integer value of from 1-24.

Exemplary useful optional cationic surfactants include quaternary ammonium compounds and salts thereof include quaternary ammonium germicides which may be characterized by the general structural formula:

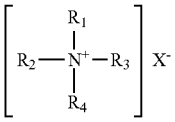

where at least one or $R_1$, $R_2$, $R_3$ and $R_4$ is a alkyl, aryl or alkylaryl substituent of from 6 to 26 carbon atoms, and desirably the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex. Exemplary counterions include halides, for example chloride, bromide or iodide, or methosulfate.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Particularly preferred quaternary ammonium compounds which act as germicides and which are be found useful in the practice of the present invention include those which have the structural formula:

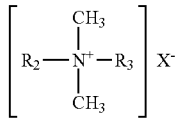

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or methosulfate. The alkyl groups recited in $R_2$ and $R_3$ may be straight-chained or branched, but are preferably substantially linear. The counterion X is as described previously.

Exemplary useful optional nonionic surfactants, include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethylenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

To be mentioned as particularly useful nonionic surfactants are alkoxylated linear primary and secondary alcohols such as those commercially available under the tradenames Poly-Tergent® SL series, Neodol® series; as alkoxylated alkyl phenols including those commercially available under the tradename Triton® X series.

Further exemplary useful nonionic surfactants which may be used include certain alkanolamides including monoethanolamides and diethanolamides, particularly fatty monoalkanolamides and fatty dialkanolamides.

Still further exemplary useful nonionic surfactants include a nonionic surfactant compound wherein a major portion of the molecule is based on polymeric alkylene oxide block copolymer. Polymeric alkylene oxide block copolymers include nonionic surfactants in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amides, phenols, thiols and secondary alcohols.

One group of nonionic surfactants containing the characteristic alkylene oxide blocks are those which may be generally represented by the formula (A):

$$HO\text{-}(EO)_x(PO)_y(EO)_z\text{—}H \quad (A)$$

where

EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO\text{—}(BO)_n(EO)_x\text{—}H \quad (C)$$

wherein R is an alkyl group containing 1 to 20 carbon atoms, n is about 15 and x is about 15.

Also useful as the nonionic block copolymer surfactants, which also include polymeric butoxy groups, are those which may be represented by the following formula (D):

$$HO\text{-}(EO)_x(BO)_n(EO)_y\text{—}H \quad (D)$$

wherein n is about 15, x is about 15 and y is about 15.

Still further useful nonionic block copolymer surfactants include ethoxylated derivatives of propoxylated ethylene diamine, which may be represented by the following formula:

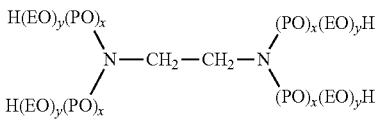

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Of these, the most preferred materials are those which are represented by formula (A) above; specific examples of particularly useful nonionic surfactant compounds which include as a major portion of the molecule a block polymeric alkylene oxide block are those materials presently commercially available under the tradename "Pluronic®", and in particular the Pluronic®F series, Pluronic®L series, Pluronic®P series, as well as in the Pluronic®R series, each of which are generally described to be block copolymers of propylene oxide and ethylene oxide. Generally those of the Pluronic®L series and the Pluronic®R series are preferred as these are supplied in liquid form by the manufacturer and are readily formulated into the present inventive compositions. These are also available in a wide range of HLB values, and those having HLB values in the range of 1.0-23.0 may be used, although those with intermediate HLB values such as from about 12.0-18.0 are found to be particularly advantageous. These materials are presently commercially available from BASF AG (Ludwigshafen, Germany) as well as from BASF Corp. (Mt. Olive Township, New Jersey).

Other useful exemplary nonionic block copolymers based on ethoxy/propoxy units which may also be used are those presently commercially available in the Poly-Tergent® E, and Poly-Tergent® P series of materials which are similarly described to be nonionic surfactants based on ethoxy/propoxy block copolymers and which are also conveniently available in a liquid form from its supplier.

Yet further exemplary useful surfactants include alkyl polyglycosides which can be used as nonionic surfactants in the composition are generally represented by formula I:

$$R_1O(R_2O)_b(Z)_a \quad I$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG, GLUCOPON, or PLANTAREN surfactants from Henkel Corporation, Ambler, Pa. 19002. Examples of such surfactants include but are not limited to: APG 225 Surfactant—an alkyl polyglycoside in which the alkyl group contains 8 to 10 carbon atoms and having an average degree of polymerization of 1.7; GLUCOPON 425 Surfactant—an alkyl polyglycoside in which the alkyl group contains 8 to 16 carbon atoms and having an average degree of polymerization of 1.48; GLUCOPON 625 Surfactant—an alkyl polyglycoside in which the alkyl group contains 12 to 16 carbon atoms and having an average degree of polymerization of 1.6; APG 325 Surfactant—an alkyl polyglycoside in which the alkyl group contains 9 to 11 carbon atoms and having an average degree of polymerization of 1.5; GLUCOPON 600 Surfactant—an alkyl polyglycoside in which the alkyl group contains 12 to 16 carbon atoms and having an average degree of polymerization of 1.4; PLANTAREN 2000 Surfactant—an alkyl polyglycoside in which the alkyl group contains 8 to 16 carbon atoms and having an average degree of polymerization of 1.4; PLANTAREN 1300 Surfactant—an alkyl polyglycoside in which the alkyl group contains 12 to 16 carbon atoms and having an average degree of polymerization of 1.6.

Exemplary useful amphoteric surfactants include alkylbetaines, particularly those which may be represented by the following structural formula:

$$RN(CH_3)_2CH_2COO\text{—}$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

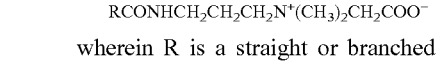

$$RCONHCH_2CH_2CH_2N^+(CH_3)_2CH_2COO^-$$

wherein R is a straight or branched hydrocarbon chain which may include an aryl moiety, but is preferably a straight hydrocarbon chain containing from about 6 to 30 carbon atoms.

The cleaning fluid may be present in the cleaning article, or alternately may be supplied to the cleaning article such as when supplied in a kit form, in any effective amount which facilitates the cleaning efficacy of the melamine foam of the cleaning article, an may be as little as 0.001% wt. based on the dry weight of the melamine foam, to as much as the amount required to fully saturate the melamine foam. Advantageously however, based on the dry weight (mass) of the melamine foam of the cleaning article, the cleaning fluid is present from between 0.1% wt, to as much as 75% wt, preferably from about 0.5% wt. to about 50% wt., more preferably from about 1% wt. to about 30% wt, yet more preferably from about 2% wt. to about 25% wt. and most preferably from about 5% wt. to about 25% wt.

As discussed above the cleaning fluid may additionally include water, especially when the cleaning fluid is supplied as an aqueous emulsion. The water may be tap water, but is preferably distilled and is most preferably deionized water or "soft" water. If the water is tap water, it is preferably substantially free of any undesirable impurities such as organics or inorganics, especially minerals salts which are present in hard water.

According to the certain aspects of the invention the cleaning fluid impregnates the melamine foam whereby said foam acts as a carrier or reservoir for the cleaning fluid. Such is particularly applicable to a kit form of the invention where a cleaning article comprising a melamine foam sponge may be supplied in a dry form, and prior to use a consumer supplies a quantity of the cleaning fluid from a vessel or container present as a part of the kit to the melamine foam prior to a cleaning operation. In other aspects of the invention the cleaning fluid is preimpregnated in the melamine foam and said foam acts as a carrier or reservoir for the cleaning fluid.

The present inventors have surprisingly found that the use of the cleaning fluid with a melamine foam, especially when the cleaning fluid melamine foam is further used in conjunction with water is highly effective in the cleaning of greasy soils from hard surfaces including painted hard surfaces. Such effect may be significantly better improved the treatment of such soils on such surfaces using only water in conjunction with the melamine foam. The present inventors have surprisingly found that still better cleaning efficacy can be attained by the use of both the cleaning fluid simultaneously with water, e.g, in the form of a partially hydrated sponge as well as in the form of water applied to the locus of a stain on a hard surface, particularly a greasy stain on a painted hard surface than with the use of the cleaning fluid without the water.

As described above, the melamine foam is used as a cleaning article, or alternately is used as part of a cleaning article.

The ultimate shape of the melamine foam is not critical to the operation of the present invention. Nor is the ultimate shape of the cleaning article critical to the operation of the invention, it only being required that the cleaning article comprise, or alternately, consist of the melamine foam. Nonetheless, the melamine foam can take on a variety of shapes including regular and irregular geometric shapes. Such include shapes include those which are essentially three-dimensional in configuration as well as those which are two-dimensional, or essentially planar or "sheet-like" configuration. With regard to three-dimensional shapes, by way of example such include regular geometric solids such as cubes, spheres, rectangles, pyramids, cylinders, cones, frustro-conical shapes, trapezoids, tetrahedrons, ellipsoids, as well as others although not specifically elucidated here. Similarly, irregular three-dimensional geometric can also be utilized as well. With regard to essentially two-dimensional shapes, these are intended to expressly include those three-dimensional shapes wherein at least one of the dimensions, e.g., length, width, thickness or height the length and the width are substantially greater than at least one of the other dimensions. Generally, this is meant to encompass three-dimensional bodies wherein the dimensions of the length and/or the width are at least 30 times, preferably at least 50 times that of the remaining dimension, here the height dimension. Such results in a generally thin, generally planar "sheet-like" configuration, as well as configurations in the form a sheet, or plate, as well as a tape or ribbon, as well as a cylindrical configuration which optionally may be hollow, e.g, tubular.

The melamine foams are preferably flexible and thus can be used directed by consumers such as by physically grasping a portion of said melamine foams, and using it to wipe, or abrade a surface in need of treatment. The flexibility of the melamine foam typically will permit for the adaptation of the said foam surface to adapt to the contours of the surface being treated. Thus, flat surfaces such as tables, walls, kitchen countertops, and the like which are essentially flat and planar in their surface configuration can be effectively treated. Also, surfaces having more convoluted geometries such as for example, curved surfaces, e.g. including parts such as handles, shafts, escutcheons, of kitchen fixtures, bathroom fixtures, and lavatory fixtures such as are used in sinks, shower stalls, bathtubs, and the like can also be effectively contacted by the melamine foam. Where the melamine foam takes the place of a two-dimensional article such as in the form of a sheet-like wipe article, even greater flexibility is imparted due to the diminishment of one or two of the dimensions relative to the remaining dimension. In this manner, effective cleaning within narrowed confines i.e. such as inside corners, as well as about articulated surfaces can also be effectively treated.

As noted previously, the melamine foam containing the cleaning fluid can itself comprise a complete cleaning article according to the invention, it can be used to form part of a cleaning article.

As to cleaning articles, it is to be understood that essentially, one or more articles of any configuration adaptable to retain the melamine foam can be used to form a cleaning article. By way of non-limiting example, a rigid or semi-rigid housing or sleeve which can at least partially grasp, at least partially enrobe or at least partially encase a melamine foam can be used. In this manner, part, or all of the melamine foam is encased by a holder which can be used to isolate the melamine foam from contact with the consumer utilizing the cleaning article.

Figure 1:
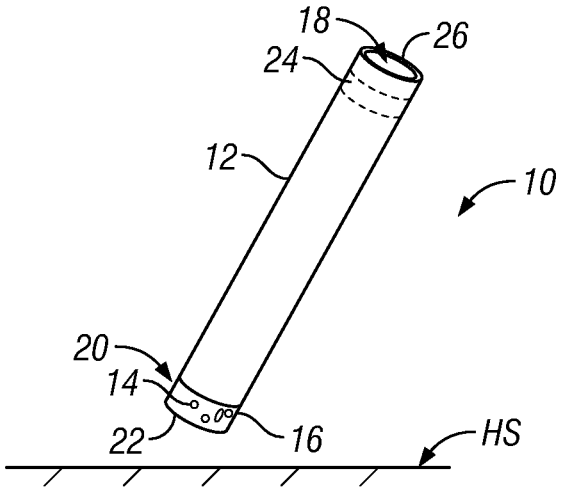

For example, in one embodiment as depicted in FIG. 1 there is provided a cleaning article 10 comprising a hollow sleeve 12 which at least partially encases a melamine foam 14 in a generally cylindrical format. The sleeve 12 is non-porous sleeve and encases a part of the exterior sidewall 16 of the melamine foam. Ideally, there is a friction-fit between the exterior sidewall 16 of the melamine foam and the inner sidewall 18 of the sleeve such that upon insertion, the melamine foam 14 does not simply fall out of the sleeve but rather requires physical interaction in order to push it out through at least one open end 20 of the sleeve. In this manner, a consumer may grasp the exterior of the sleeve, and apply the exposed portion or end 22 of the melamine foam directly to a hard surface (HS) in need of treatment. In such an embodiment, contact between the melamine foam containing the cleaning fluid and the consumer in minimized. In this embodiment, the sleeve 12 may be provided with a slideable piston 24 (depicted in phantom) at the sleeve end 26 opposite the open end through which the melamine foam 14 extends. In use, a consumer may dispense additional amounts of the melamine foam 14 by depressing or pushing the piston 24 through the open sleeve end 26 which in turn causes the melamine foam to be expelled from the sleeve, exposing its end 22 as needed.

Figure 2:
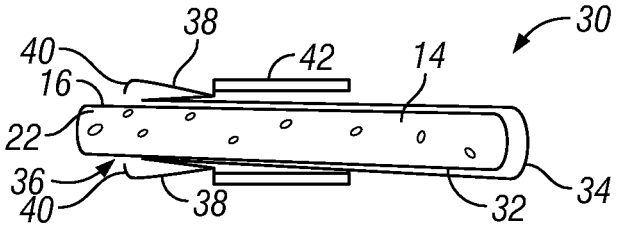
FIG. 2 illustrates a cross-sectional view of a further embodiment of a cleaning implement.

In another embodiment depicted on FIG. 2 there is provided a cross-sectional view of a further cleaning article 30. In this embodiment there is depicted a hollow cylindrical sleeve 32 which at least partially encases a melamine foam 14. The hollow cylindrical sleeve has one closed end 34 and at the opposite end thereof has an open end 36 through which a part 22 of the melamine foam is extends or is exposed. In this embodiment the dimensions of the sleeve 32 and the melamine foam 14 are such that the melamine foam is loosely, slidably present within the sleeve 32, although a tighter friction fit is also possible. Attached to, or alternately formed as a part of the sleeve 32 is at least one flexible prong 38; here two are depicted. Each flexible prong has one gripper 40 which is adapted to physically engage the melamine foam 14 at or near the open end 36 of the sleeve 32. Further provided is a displaceable locking means, here a barrel section 42 which is slideably moveable along the exterior of the sleeve 32, such that when it is moved towards the open end 36 of the sleeve 32 the flexible prongs 38 are compressed and the gripper end 40 engages an exposed part of the exterior sidewall 16 of the melamine foam 14. This acts a locking means and a retention means, positioning the melamine foam 14 in a fixed position. As the exposed end 22 of the melamine foam 14 is consumed, a consumer may withdraw the barrel section 42 from the prongs by moving it towards the closed end 34, which permits the gripper ends 40 to disengage and allow for the melamine foam 14 to slide outwardly from the sleeve 12. When a suitable or desired amount of the melamine foam 14 is now exposed, the consumer may replace the barrel section 42, compressing the prongs 38 thereby causing the gripper ends 40 to engage the exterior sidewall 16 of the melamine foam 14.

With respect to the foregoing, it is to be understood that such embodiments are illustrative and various alternations may be made without detracting from the inventive scope. For example, the relative dimensions of the cleaning devices 10, 30 can differ from those depicted, the cross-sectional geometries of the sleeves 12 and of the melamine foam 14 may be of different shapes other than cylindrical having a circular cross section. For example triangular, square, rectangular, pentagonal, hexagonal, elliptical, oblate as well as irregular geometric shapes may be utilized as well.

Figure 3A:
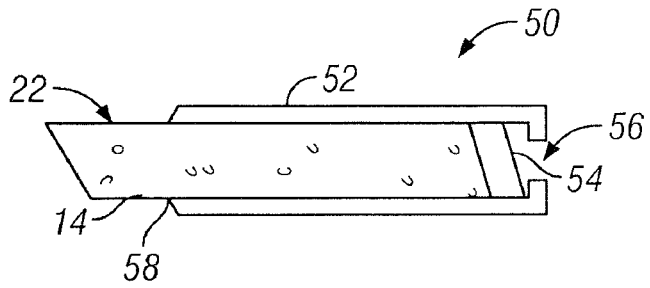
FIG. 3A illustrates view of a further alternative embodiment of a cleaning implement.

With respect now to FIG. 3A depicting in a cross-sectional view a further alternative embodiment of a cleaning article 50 according to the invention. Herein the melamine foam 14 is provided as a generally rectangular body having, as shown in this side cross-sectional view, a parallelogram cross-sectional shape. In such a three-dimensional format, a housing 52 may be provided which is used to encase a portion of the melamine foam, while permitting for an exposed portion 22 extend outwardly from the housing 52. In such an embodiment, a cavity is formed within the interior of such an article, and at least a portion of the melamine foam is insertable within. During use, as the melamine foam is abraded and disintegrates, the exposed portion 22 of the melamine foam 14 decreases in size until it is largely consumed. At such time, the consumer may choose to merely discard the remaining portion of the holder and the melamine foam and utilize a new article for a further cleaning operation, or alternately, as is made possible by the use of the depicted embodiment a moveable piston 54 may be pushed by a consumer through an open end 56 of the housing 52 which in turn causes the melamine foam 14 to be extended outwardly out of the opposite open end 58 of the housing 52.

Figure 3B:
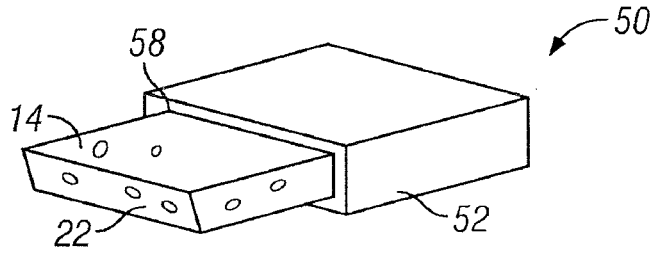
FIG. 3B illustrates a perspective view of the cleaning implement of FIG. 3A.

FIG. 3B depicts a perspective view of the embodiment described with reference to FIG. 3A.

FIG. 4 depicts a cross-sectional, side view of a further embodiment of a cleaning article 60 according to the present invention. In the embodiment depicted there is provided a housing 62 adapted to receive a melamine foam 14 at least partially within. The housing 62 includes two open ends, a first open end 64 through which a part of the melamine foam 14 extends and is exposed 22, and a second open end 66, opposite. The embodiment shown depicts one means whereby, upon consumption of the exposed end 22 of the melamine foam 14, a further portion of the melamine foam 14 may be extended through the first open end 64. Abutting one end of the melamine foam 14 is a slideable piston 68 having one or more extensions 70 extending from the piston sidewall 72, one or more of said extensions 70 being engageable within corresponding sidewall recesses 74 which are present within the interior wall 76 of the housing 62. Preferably, either the housing 62 or the extensions 70 or both are sufficiently flexible or otherwise displaceable such that when pressure is exerted on the piston 68 causing it to move towards the first open end, the piston 68, the extensions 70 may slip out from the current sidewall recess 74 in which they are positioned, slide along the interior wall 76 and become engaged in an adjacent sidewall recess 74. Such action causes the melamine foam 14 to be displaced and extend outwardly from the housing 62 through the first open end. Such also provides an anti-retraction feature as compression of the exposed part or end 22 of the melamine foam 14 would not cause the piston 68 to move due to the compressability of the melamine foam 14.

In any of the foregoing exemplary embodiments it is also contemplated that the cleaning articles described may be provided as either single-use articles, or may be reusable when provided with appropriate refills which comprise the melamine foam containing a cleaning fluid which is appropriately dimensioned for a specific article.

The materials of construction of the elements of a cleaning article other than that of the melamine foam may be of any suitable material and preferably at least the housing of any cleaning article is formed of a non-porous material. Metals, paper, coated paper as well as synthetic polymers such as thermoforming or thermosetting synthetic polymers are contemplated as being particularly useful as being readily formable and available at a reasonable cost. Polyolefins such as polypropylene, polyethylene, polystyrene, polyamides such as nylons as well as polyalkylene terephthalates and polysulfones are contemplated as being particularly useful.

According to a yet further aspect of the invention the cleaning fluid is not preimpregnated into the melamine foam prior to the use of the cleaning article but rather, may be provided in a sachet or package which contains the cleaning fluid which sachet or package is affixed to a surface, but is preferably located within the interior of the cleaning article. In use the cleaning fluid is released from the sachet, packet or package (hereinafter referred so as the "sachet") into the melamine foam.

The sachet may be formed from a water soluble material, such as a water soluble or water dispersible polymeric film, or alternately may be formed from a water insoluble material, such as a water insoluble polymeric film. Additionally the sachet may be formed in a manner where only part of the sachet is physically breachable or is water soluble or dispersible.

A sachet containing the cleaning fluid can be a single such sachet, or can be a plurality of sachets. With regard to the former option, it is contemplated that the chemical composition, as well as the wall thickness of the material used to form the sachet may be selected so that it is insoluble, or only very poorly soluble when in contact with the cleaning fluid however, is adequately, or preferably is substantially soluble in water. It is contemplated that the sachet, when contacted with water which comes into contact with the melamine sponge and passes into its interior, thereby contacting the outer surface or outer wall of the sachet at least partially dissolves or disperses and releases the cleaning fluid into the cleaning article, most preferably into the melamine foam. Desirably the at least a portion of the sachet dissolves within a reasonably short amount of time, i.e. between 0.5-180 seconds, preferably between 0.5-120 seconds, more preferably between about 1-60 seconds such that upon its initial contact with water, the contents of the sachet are allowed to leach into the melamine foam. In this manner, a packaged cleaning article can be provided wherein the melamine foam is in a substantially dry state yet, upon its first use as a cleaning article, the action of the water used to initially rinse the melamine foam acts to both hydrate the foam and to simultaneously release the cleaning fluid into the interior of the melamine foam.

Advantageously, as is depicted in the cross-sectional depiction of FIG. 5, a sachet 82 containing a quantity of a cleaning fluid 84 is preferably positioned in contact with the melamine foam of the cleaning article 80; here a particularly preferred embodiment depicts a sachet which had been inserted into the interior of a melamine foam body by forming a slit partially into the melamine foam. The position of the slit is indicated by the dotted line 86.

It is to be understood that such a sachet may also be provided on or adjacent to the exterior of the melamine foam, as placement within the interior of the melamine foam is not essential although is preferred.

It is also contemplated that a plurality of sachets having different delivery characteristics can also be utilized. For example, in one such alternative embodiment, two or more sachets are provided each having different wall thicknesses, and/or are formed of water-soluble films having differing degrees of aqueous solubility. In this manner, it is foreseen that the sachets will dissolve at different times and/or under different levels of aqueous hydration of the melamine foam. Such may be particularly advantageous from a consumer standpoint in that plural, or multiple releases of the cleaning fluid may be delivered to the melamine foam during the useful life of the cleaning article. For example, a first quantity of cleaning fluid can be provided to a first packet or sachet which rapidly dissolves while a second or further quantity of a cleaning fluid can be provided to a corresponding second or further sachets which have increasing resistance to aqueous solubility when wetted with water. The latter packets or sachets would be expected to dissolve at a time later than the dissolution of the initial packet and the initial release of its quantity of cleaning fluid. In this way, subsequent dosings of the cleaning fluid can be provided to the melamine foam of the cleaning article. Such could be particularly advantageous to a consumer wherein the melamine foam sponge is expected to be used, and rinsed a plurality of times. In this way, the initial dose of the cleaning fluid which may have been exhausted can be replenished by the later releases of subsequent amounts of the cleaning fluid.

The use of multiple sachets also permits for the delivery of dissimilar cleaning fluids to the melamine foam as well. For example, at least two sachets having different dissolution characteristics may be provided in a cleaning article, whereby a first, colorless cleaning fluid is initially released to the melamine foam. Only at a later time a visibly colored fluid, i.e, one which may contain a visible pigment or dye is released upon dissolution or breaching of a second sachet. Such colored fluid may be a further cleaning fluid as defined herein but need not be; the appearance of a color change in the melamine foam may act as a visual indicator, such as an end-of-life indicator to a consumer suggesting that the melamine foam and/or the cleaning article be discarded or alternately, replenished.

It is contemplated that any material which exhibits a useful degree of aqueous solubility may be utilized to form all or part of a sachet. Exemplary materials include poly(vinylalcohol) based homopolymers, copolymers or graft polymers, polyethylene oxide and cellulose derivatives which may be molded into forms or cast into films. Desirably the material is poly(vinylalcohol). The poly(vinylalcohol) may be partially or fully alcoholized or hydrolyzed. For example, it may be from 40 to 100% preferably 70 to 92%, more preferably about 88%, alcoholized or hydrolyzed, polyvinyl acetate. When the material is in film form, the film may be cast, blown or extruded. Although not specifically elucidated here it is to be understood that other water soluble or water dispersible materials which may be formed into sachets are also contemplated as being useful.

While water soluble or water dispersible materials useful for making a sachet may be soluble in water at different temperatures, soluble in warm water or hot water having a temperature of, for example, 30° C., 40° C., 50° C. or even 60° C., preferably such materials are selected such that at least a part of the sachet is soluble or dispersible in generally cold water (15° C.-20° C.).

Such sachets may be formed according to techniques known in the art. The sachets useful in the invention may be flexible or may be rigid, such as may be obtained by thermoforming An exemplary method of thermoforming the sachet is similar to the process described in WO 92/17382. A first poly (vinyl alcohol) ("PVOH") film is initially thermoformed to produce a non-planar sheet containing a pocket, such as a recess, which is able to retain the aqueous composition. The pocket is generally bounded by a flange, which is preferably substantially planar. The pocket may have internal barrier layers as described in, for example, WO 93/08095. The pocket is then filled with the cleaning fluid, and a second poly(vinyl alcohol) film is placed on the flange and across the pocket. The second poly(vinyl alcohol) film may or may not be thermoformed. If the first film contains more than one pocket, the second film may be placed across all of the pockets for convenience. The pocket may be completely filled, or only partly filled, for example to leave an air space of from 2 to 20%, especially from 5 to 10%, of the volume of the container immediately after it is formed. Partial filling may reduce the risk of rupture of the container if it is subjected to shock and reduce the risk of leakage if the container is subjected to high temperatures. The films are then sealed together, for example by heat sealing across the flange. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

Where the material used to form the sachets is in the form of a flexible film, known art techniques may be used in order to form sachets, fill the sachets with appropriate quantities of a cleaning composition and seal the sachets. Such are per se, known to the art and generally contemplate the formation of a sachet from one or more pieces of film (the compositions may be the same or different, e.g., one may be water soluble while the other may have a different aqueous solubility or be water-insoluble) which are folded or sealed to form a pocket, filled and thereafter sealed, e.g. by heat sealing, use of an aqueous solution of PVOH, an adhesive, or for example infra-red, radio frequency, ultrasonic, laser, solvent, vibration or spin welding.

It is also contemplated that the cleaning fluid can be provided in a sachet which is formed of a water-insoluble film or rigid molded article. By way of non-limiting example such water-insoluble materials include one or more water-insoluble polymers such as polyolefins, polyamides, etc. Also contemplated as being useful are other water-insoluble materials, e.g., metallic foils and films, multi-layered materials such as coated paper which provides a fluid retardant barrier to the cleaning fluid, etc. According to such an embodiment, the action of hydrating the melamine foam does not cause the dissolution of the film rather, rather a physical interaction or intervention by the consumer with the sachet is required to causes the release of the cleaning fluid contained within. Such an physical interaction or intervention may be an act performed directly by the consumer, or an act performed by the consumer via the use of an intermediate means such as a tool, which act is effective in breaching at least a portion of the sachet and thereby permit for the release of the cleaning fluid from within its interior and to be delivered to the melamine foam can be used. For example, the packet or sachet can be made of a water-insoluble polymeric film which is stiff or rigid but frangible, wherein a consumer causes the sachet to breach by merely twisting or bending the sponge, thereby causing at least a portion of the sachet to break and release its contents into the melamine foam. In another alternative, a flexible, water-insoluble polymeric film is utilized. According to such an embodiment, the quantity of the cleaning fluid is such that when present in the sachet provides very little gas or headspace thereby facilitating the manual bursting of the packet or sachet by compression or twisting of the packet or sachet by the consumer. For example, in a particularly simple manner, the consumer may place such a cleaning article upon a hard surface, and by simple pressure upon the cleaning article, and/or the melamine foam, cause the packet or sachet to burst and release its contents to the melamine foam. In a yet further embodiment it is contemplated that a tool may be used to release the cleaning fluid to the melamine foam. For example, the packet or sachet may be made of a polymeric film which may or may not be water-soluble but which is intended to be breachable by use of such a tool. In a very simple embodiment, a pointed instrument such as a stylus or a pin can be used to cause localized compression of the sachet and cause it to rupture or burst, and/or can be used to pierce the side wall of the packet or sachet. In any case, such causes the release of the cleaning fluid to the melamine foam.

In a still further aspect of the invention, it is contemplated that the cleaning article, which may be simply a melamine foam in a two or three-dimensional format as described above, or alternately which may be provided as a cleaning article which incorporates as part of its construction a melamine foam article, is provided in the form of a kit. The kit is simply a package or a combination of the aforesaid cleaning article with a container or reservoir which can be used by a consumer to dispense a quantity of the cleaning fluid as may be needed. For example, the cleaning fluid can be provided in either a single use, or in a resealable container adapted for containing liquids. The consumer may dispense to the melamine foam on an as-needed basis further quantities of the cleaning fluid during the useful life of the cleaning article. In this manner, the melamine foam can be periodically replenished with the cleaning fluid as believed to be needed by the consumer.

According to a still further aspect of the invention there is provided a kit which includes one or more cleaning article(s) based on a melamine foam, and at least one container which comprises a cleaning fluid as described previously.

It is also contemplated that the cleaning article in the invention may comprise a multi-layered material wherein at least one of the layers is a melamine foam layer. For example, it is contemplated that one or more further layers of material other than the melamine foam can be provided and utilized with the cleaning article. For example, in one embodiment it is contemplated that an abrasive material is also provided. The addition of such an abrasive material may be used to pre-treat a stubborn stain on a hard surface, thereby loosening the stain and improving the cleaning ability of the melamine foam containing the cleaning fluid. In another alternative embodiment, an absorbent material such as a woven or non-woven wipe may also desirably be associated with the cleaning article. In such an embodiment, the absorbent wipe or the material may provide each of the following effects. Wherein the absorbent wipe is essentially dry then, it can be used to wick away any excess fluid from the melamine foam. Alternately, if the absorbent material is wetted such as by water or other fluid, then it may be used to wipe a surface either prior to, or after application of the cleaning fluid via the melamine foam to the surface. As the melamine foam is hydrophobic in nature, it is foreseeable that the use of the cleaning article may result in residual droplets of fluid on a surface after being treated with the melamine foam, particularly when the cleaning fluid is used in conjunction with an aqueous composition in treating a hard surface. In this manner, the absorbent wipe may be used to advantageously absorb any remaining fluid droplets from a surface and thereby reduce any tendency for streaks or spotting on the treated hard surface. It is contemplated that other materials including hydrophilic sponges, e.g. cellulose sponges as well as polyurethane sponges can also be used to form one or more of the layers used in conjunction with the melamine foam. The provision of hydrophilic sponges provides for an absorbent layer which may be used to wipe a surface either prior to, or after application of the cleaning fluid via the melamine foam to the surface, especially if the surface is subsequently rinsed with water following treatment with the melamine foam and the cleaning fluid. The provision of a hydrophilic sponge layer may also act as a reservoir for water which may be released to a hard surface in conjunction with the cleaning fluid during the treatment of a stain.

With regard to the cleaning articles, it is to be contemplated that further materials and/or further articles may be associated with the cleaning article described herein. Such alternate materials may take any shape or form and can include, for example handles, grasping implements, and the like.

Further materials which are particularly advantageously used in certain configurations of cleaning articles which are considered within the scope of the present invention include pads, woven sheets, non-woven sheets, abrasive pads, and the like. For example, according to certain particularly preferred embodiments of a cleaning article according to the present invention, a non-woven abrasive material, generally in the form of a pad, is bonded to the melamine foam. While any bonding means can be used, inter alia, stitching, adhesive, and the like, it is expressly contemplated that such an abrasive article may be bonded to the melamine foam during its polymerization from its starting materials. Such a technique is preferred as there is formed a physical bond between the melamine foam and the abrasive article which obviates the need for stitching, and or the need for an intermediate adhesive, or for other additional means which may unnecessarily increase the cost, or require a further manufacturing step.

According to a particularly preferred aspect of the invention there is provided a cleaning article which comprises a melamine foam which has affixed thereto at least one layer of a fibrous substrate. By way of non-limiting examples, useful fibrous substrates can be of a woven or non-woven nature, and may take a variety of forms. Exemplary useful fibrous substrates can include nonwoven or woven materials (fabrics), and such substrates can be resin bonded, hydroentanged, thermally bonded, meltblown, needlepunched or any combination of the former. Such substrates may be formed form virtually any material including fibrous materials obtained from synthetic as well as naturally occurring sources. Nonwoven fibrous substrates are typically preferred from a cost standpoint however, nothing should be understood to inhibit the use of woven fibrous substrates as well.

Nonwoven fibrous substrates may be a combination of wood pulp fibers and textile length synthetic fibers formed by well known dry-form or wet-lay processes. Synthetic fibers such as rayon, nylon, orlon and polyester as well as blends thereof can be employed, with or without fibers obtained from naturally occurring sources, e.g., wood pulp fibers, cellulose and the like. In certain embodiments, the wood pulp fibers should comprise about 30 to about 60 percent by weight of the nonwoven fabric, preferably about 55 to about 60 percent by weight, the remainder being synthetic fibers. The wood pulp fibers provide for absorbency, abrasion and soil retention whereas the synthetic fibers provide for substrate strength and resiliency.

Examples of commercially available and particularly useful fibrous substrates include: Dexter® 10494 which is described to be a 70% viscose/30% polyolefin blend; Dexter® 5608 which is described to be a 45% cellulose/55% polyester and polypropylene blend; Dexter® 12086 which is described to be a 65% cellulose/30% rayon/5% synthetic fiber blend; Dexter® 8553-55 which is described to be approximately 80% cellulose, 20% rayon blend; Dexter® 12131 described to be a 65% cellulose/30% polyester blend containing a further 5% of a binder material; Dexter® 10471 which is described to be a 75% cellulose/7% rayon/10% polyester and 8% polyolefin blend; Spuntech® A080 described to be a 70% cellulose/30% polyester blend; Fiberlla® 4300 described to be a 50% cellulose/50% polyester blend; Vicotex® D6M-45 described to be a viscose/polyester blend; as well as Albad® SP50 described to be a 70% cellulose/30% polyester blend. Further and preferred examples of useful fibrous substrates are recited with reference to one or more of the Examples.

The fibrous substrates are typically supplied in the form of sheets or wide ribbons which are generally planar. Certain fibrous substrates including those which are amongst the preferred embodiments are constructed to provide an abrasive effect when applied to surfaces. Other fibrous substrates including those which are also amongst the preferred embodiments include those having a "quilted" pattern wherein regions of the fibrous substrate extend outwardly from the plane of the fibrous substrate thereby imparting a three-dimensional appearance.

A particularly preferred embodiment of a cleaning article according to the invention includes a melamine foam layered in register with, or otherwise having affixed to at least one surface of the melamine foam a fibrous substrate layer which is constructed to provide an abrasive effect. Such an embodiment provides dual-function in that the abrasive layer may be used to initially improve the removal of soils or other materials on hard surfaces, while the melamine foam layer containing the cleaning fluid may be applied to solubilize the soils or other materials on the hard surface.

A further advantageous embodiment of the invention is disclosed in FIG. 6. Therein is depicted an embodiment of a cleaning article 90 which comprises a multi-layered construction which includes a melamine foam 14 having one surface layered in register with a non-woven abrasive layer 92. Intermediate these two layers is provided a sachet 94 containing a quantity of a cleaning composition 96 within.

The melamine foam layer with at least one further, non-melamine foam layer can be provided as discrete elements of the cleaning article, but are advantageously provided as a multi-ply, or multi-layer construction. In this manner, the melamine foam forms a first layer, and a second (as well as any additional layers) can be physically applied thereto and in contact therewith. Any means known to the art suitable for joining such materials can be used. For example, the melamine foam layer can be attached to a further layer by a permanent joining means such as by foam flame lamination, use of a permanent adhesive, needle punching, sewing, as well as other means known to the art whereby the melamine foam layer and any further layers can be joined in an essentially permanent fashion. Alternately, it is also contemplated that the melamine foam layer and any further layer or layers can be removeably affixed to one another by any suitable fastening means. For example, contemplated are mechanical fastening means such as hook-and-loop type fasteners, pins, snaps, as well as other means for mechanically engaging adjoining layers and affixing them to each other. Also contemplated are adhesive compositions that can be reapplied or which can be reused a multiplicity of times in order to adhere the melamine foam to any second or further layers.

Certain embodiments of the invention, including certain preferred embodiments are disclosed in the following examples.

EXAMPLES

The cleaning performance of BASOTECT sponges impregnated with cleaning fluids was evaluated for their cleaning performance Cleaning evaluations were performed in accordance with the testing protocol outlined according to ASTM D4488 A2 Test Method, which evaluated the efficacy of the cleaning compositions in removing a standardized greasy organic soil on masonite wallboard samples painted with white wall paint. The soil applied was a standardized greasy soil containing:

| Test Greasy Soil | % w/w |
|---|---|
| vegetable oil | 33 |
| vegetable shortening | 33 |
| lard | 33 |
| carbon black | 1 |

which were blended together to homogeneity under gentle heating to form a uniform mixture which was later allowed to cool to room temperature.

Each sponge was prepared by subjecting it to one of the following described preparation protocols:

Protocol "A": to a sample sponge is provided a deionized water in sufficient quantity to saturate the sponge, and thereafter the sponge was manually firmly squeezed in order to maximally compress the sponge and expel at least a major part of the supplied deionized water, with the result being a moist sponge ready for later testing or use;

Protocol "B": to a sample sponge is first provided a sufficient amount of Dow Corning 245 fluid which was used "as supplied", whereas the Dow Corning 245 fluid was supplied via a pipette to the dry sponge in an amount equal to the weight of the dry sponge and allowed to soak into the sponge. Thereafter, the sponge was manually firmly squeezed in order to maximally compress the sponge and expel at least a major part of the supplied deionized water, with the result being a moist sponge ready for later testing or use;

Protocol "B-W": to a sample sponge is first provided a sufficient amount of Dow Corning 245 fluid which was used "as supplied", whereas the Dow Corning 245 fluid was supplied via a pipette to the dry sponge in an amount equal to the weight of the dry sponge and allowed to soak into the sponge. Thereafter, there was additionally provided to the sponge deionized water in sufficient quantity to saturate the sponge, and thereafter the sponge was manually firmly squeezed in order to maximally compress the sponge and expel at least a major part of the supplied deionized water, with the result being a moist sponge ready for later testing or use;

Protocol "C": to a sample sponge is first provided a sufficient amount of Dow Corning 245 fluid which was used "as supplied", whereas the Dow Corning 245 fluid was supplied via a pipette to the dry sponge in an amount of 2 times the weight of the dry sponge and allowed to soak into the sponge. Thereafter, there was additionally provided to the sponge deionized water in sufficient quantity to saturate the sponge, and thereafter the sponge was manually firmly squeezed in order to maximally compress the sponge and expel at least a major part of the supplied deionized water, with the result being a moist sponge ready for later testing or use;

Protocol "C-W": to a sample sponge is first provided a sufficient amount of Dow Corning 245 fluid which was used "as supplied", whereas the Dow Corning 245 fluid was supplied via a pipette to the dry sponge in an amount of 2 times the weight of the dry sponge and allowed to soak into the sponge. Thereafter, there was additionally provided to the sponge deionized water in sufficient quantity to saturate the sponge, and thereafter the sponge was manually firmly squeezed in order to maximally compress the sponge and expel at least a major part of the supplied deionized water, with the result being a moist sponge ready for later testing or use;

Protocol "D": to a sample sponge is first provided a sufficient amount of Dow Corning 245 fluid which was used "as supplied", whereas the Dow Corning 245 fluid was supplied via a pipette to the dry sponge in an amount of 5 times the weight of the dry sponge and allowed to soak into the sponge. Thereafter, the sponge was manually firmly squeezed in order to maximally compress the sponge and expel at least a major part of the supplied deionized water, with the result being a moist sponge ready for later testing or use;

Protocol "D-W": to a sample sponge is first provided a sufficient amount of Dow Corning 245 fluid which was used "as supplied", whereas the Dow Corning 245 fluid was supplied via a pipette to the dry sponge in an amount of 5 times the weight of the dry sponge and allowed to soak into the sponge. Thereafter, there was additionally provided to the sponge deionized water in sufficient quantity to saturate the sponge, and thereafter the sponge was manually firmly squeezed in order to maximally compress the sponge and expel at least a major part of the supplied deionized water, with the result being a moist sponge ready for later testing or use;

Protocol "E": The procedure according to Protocol "C" were repeated, but Neodol 91-6, a nonionic surfactant was used "as is" in place of the Dow Corning 245 fluid.

Protocol "E-W": The procedure according to Protocol "C-W" were repeated, but Neodol 91-6, a nonionic surfactant was used "as is" in place of the Dow Corning 245 fluid.

Protocol "F": The procedure according to Protocol "C" were repeated, but Neodol 91-8, a nonionic surfactant was used "as is" in place of the Dow Corning 245 fluid.

Protocol "F-W": The procedure according to Protocol "C-W" were repeated, but Neodol 91-8, a nonionic surfactant was used "as is" in place of the Dow Corning 245 fluid.

Protocol "G": The procedure according to Protocol "C" were repeated, but Isopar H, a paraffinic hydrocarbon solvent was used "as is" in place of the Dow Corning 245 fluid.

Protocol "G-W": The procedure according to Protocol "C-W" were repeated, but Isopar H, a paraffinic hydrocarbon solvent was used "as is" in place of the Dow Corning 245 fluid.

Protocol "H": The procedure according to Protocol "C" were repeated, but Isopar K, a paraffinic hydrocarbon solvent was used "as is" in place of the Dow Corning 245 fluid.

Protocol "H-W": The procedure according to Protocol "C-W" were repeated, but Isopar K, a paraffinic hydrocarbon solvent was used "as is" in place of the Dow Corning 245 fluid.

Protocol "I": The procedure according to Protocol "C" were repeated, but Rhodorsil (ex. Rhodia) a commercially available polydimethylsiloxane solvent was used "as is" in place of the Dow Corning 245 fluid.

Protocol "I-W": The procedure according to Protocol "C-W" were repeated, but Rhodorsil (ex. Rhodia) a commercially available polydimethylsiloxane was used "as is" in place of the Dow Corning 245 fluid.

Protocol "J": The procedure according to Protocol "C" were repeated, but Dowanol DPnB (dipropylene glycol n-butyl ether, ex. Dow Corp.) a hydrocarbon solvent was used "as is" in place of the Dow Corning 245 fluid.

Protocol "J-W": The procedure according to Protocol "C-W" were repeated, but Dowanol DPnB (dipropylene glycol n-butyl ether, ex. Dow Corp.) a hydrocarbon solvent was used "as is" in place of the Dow Corning 245 fluid.

After being prepared by one of the foregoing preparation protocols, the prepared sponge thereafter placed into the holder of a Garner BYK abrasion with the exposed surface of the sponge contacting the soiled surface of the soiled wallboard sample and then apparatus was cycled 6 times. The tiles were dried, and then the cleaning efficacy was evaluated utilizing a Qlmaging Retiga series CCD camera upon which was mounted a Schneider-Kreuznach Cinegon Compact series, model 1.9/10 mm lens which was mounted on a camera stand at standardized distance from a platform upon which each wallboard tile was placed, such that the focal plane of the CCD camera was parallel to the surface of the wallboard tile, which was a distance of approximately 10 inches. This distance was sufficient such that the total surface of the wallboard tile could be captured by the CCD camera. The CCD camera, camera stand were placed within a sealed light box having two light sources which are positioned on opposite sides of the platform such that the platform and the wallboard tile are evenly illuminated at a consistent level. All wallboard tiles were evaluated under identical camera, focus and lighting conditions to eliminate variability in the testing protocol for each set of wallboard tiles evaluated. The CCD camera was appropriately coupled to a general purpose desktop computer (Windows XP operating system) and a image capture and evaluation software program (Media Cybernetics Image Pro Plus v. 6.0) was used to take an instantaneous image reading, and evaluate the image of the surface of the wallboard tile in order to determine the spectrophotomic characteristics of the tile surface. The instantaneous image reading was used to generate a histogram (light intensity) of the surface of the tile to be tested.

The percentage of the test greasy soil removal from each tile was determined utilizing the following equation:

$$\% \text{ Removal} = \frac{RC - RS}{RO - RS} \times 100$$

where

RC=histogram reading of tile after cleaning with test product

RO=histogram reading of original soiled tile

RS=histogram reading of soiled tile

The results of this evaluation was averaged for each of the tested compositions, and the results of the evaluation are reported on the following Table A.

TABLE A

| Example | Cleaning fluid and Protocol | % Cleaning (% test greasy soil removed) |
|---|---|---|
| C1 | d.i. water, Protocol A | 62.0 |
| E1 | Dow Corning 245 fluid, Protocol C-W | 61.3 |
| C2 | d.i. water, Protocol A | 55.8 |
| E2 | Dow Corning 245 fluid, Protocol D-W | 56.7 |
| E3 | Dow Corning 245 fluid, Protocol C-W | 63.7 |
| C3 | d.i. water, Protocol A | 58.5 |
| C4 | d.i. water, Protocol A | 65.1 |
| E4 | Dow Corning 245 fluid, Protocol B-W | 79.9 |
| E5 | Dow Corning 245 fluid, Protocol C-W | 67.4 |
| E6 | Dow Corning 245 fluid, Protocol B-W | 53.8 |
| E7 | Dow Corning 245 fluid, Protocol C-W | 73.9 |
| E8 | Dow Corning 245 fluid, Protocol B-W | 61.0 |
| E9 | Dow Corning 245 fluid, Protocol B-W | 67.4 |
| E10 | Dow Corning 245 fluid, Protocol D-W | 74.5 |
| E11 | Dow Corning 245 fluid, Protocol C-W | 85.0 |
| E12 | Dow Corning 245 fluid, Protocol B-W | 80.8 |
| E13 | Dow Corning 245 fluid, Protocol C | 52.7 |
| E14 | Dow Corning 245 fluid, Protocol C-W | 78.0 |
| C5 | d.i. water, Protocol A | 59.4 |
| E15 | Dow Corning 245 fluid, Protocol C | 38.4 |
| E16 | Dow Corning 245 fluid, Protocol C-W | 86.3 |
| E17 | Dow Corning 245 fluid, Protocol C | 31.9 |
| E18 | Dow Corning 245 fluid, Protocol C | 24.1 |
| E19 | Dow Corning 245 fluid, Protocol C-W | 92.4 |
| E20 | Dow Corning 245 fluid, Protocol C-W | 98.4 |
| E21 | Neodol 91-6, Protocol E | 45.8 |
| E22 | Neodol 91-6, Protocol E-W | 81.2 |

TABLE A-continued

| Example | Cleaning fluid and Protocol | % Cleaning (% test greasy soil removed) |
|---|---|---|
| E23 | Isopar H, Protocol G | 34.1 |
| E24 | Isopar H, Protocol G-W | 72.3 |
| E25 | Neodol 91-6, Protocol F | 58.2 |
| E26 | Neodol 91-6, Protocol F-W | 65.7 |
| E27 | Isopar K, Protocol H | 20.7 |
| E28 | Isopar K, Protocol H-W | 63.9 |
| E29 | Rhodorsil, Protocol I | 35.4 |
| E30 | Rhodorsil, Protocol I-W | 68.4 |
| E31 | DPnB, Protocol J | 45.9 |
| E32 | DPnB, Protocol J-W | 90.9 |

In the foregoing table, cleaning fluid compositions which consisted solely of water were identified as "comparative" examples and labeled using a "C" and fall outside of the scope of the present invention. The remaining examples wherein the sponges were preimpregnated with a cleaning fluid and labeled using an "E" are considered to fall within the scope of the present invention.

As can be seen from the foregoing results of Table A, the sponge articles which included a cleaning fluid composition which included a hydrophobic liquid composition, e.g., a hydrophobic silicone emulsion composition, a hydrophobic volatile silicone derivative, a silane, a hydrophobic volatile organic solvent composition, a paraffinic hydrocarbon, or alternately a surfactant composition initially present in the sponge article, which was later contacted with water and then used to clean a greasy soil on a hard surface typically exhibited improved cleaning performance than compared with a like sponge which included one of the foregoing compositions without water, or a like sponge which included only water.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

The invention claimed is:

1. A cleaning article which comprises:

a housing having a moveable piston;

a non-aqueous cleaning fluid which includes at least 50% wt. of a hydrophobic liquid composition, contained in an abradable melamine foam which disintegrates during use, having an essentially three-dimensional configuration and which is moveably engaged with said housing, said foam having a first portion and a second portion, said first portion of said foam being encased within said housing and said second portion of said foam extending outwardly from said housing such that said second portion is exposed from said housing;

wherein upon said piston being moved in a direction such that said piston contacts said first portion of said foam, said foam moves in the same direction as said piston whereupon said second portion of said foam is further extended outwardly from said housing.

2. A cleaning article according to claim 1 wherein the cleaning fluid includes a hydrophobic silicone emulsion composition.

3. A cleaning article according to claim 2 wherein the cleaning fluid includes a hydrophobic volatile silicon derivative.

4. A cleaning article according to claim 1 wherein the cleaning fluid includes a hydrophobic volatile organic solvent composition.

5. A cleaning article according to claim 1 wherein the cleaning fluid includes a paraffinic hydrocarbon.

6. A cleaning article according to claim 1 wherein the cleaning fluid includes a surfactant.

7. A cleaning article according to claim 1 wherein the cleaning fluid includes water.

* * * * *